US006472982B2

(12) United States Patent
Eida et al.

(10) Patent No.: US 6,472,982 B2
(45) Date of Patent: Oct. 29, 2002

(54) VEHICULAR COMMUNICATION APPARATUS, COMMUNICATION METHOD AND COMPUTER-READABLE STORAGE MEDIUM THEREFOR

(75) Inventors: Masataka Eida, Kanagawa (JP); Sadayuki Sugama, Ibaraki (JP); Mamoru Sakaki, Kanagawa (JP); Masako Shimomura, Kanagawa (JP); Noriyasu Asaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,167

(22) Filed: Nov. 28, 2001

(65) Prior Publication Data

US 2002/0063637 A1 May 30, 2002

(30) Foreign Application Priority Data

Nov. 30, 2000 (JP) ..... 2000-365836

(51) Int. Cl.[7] ..... G08B 1/08

(52) U.S. Cl. ..... 340/539; 340/426; 701/49; 701/301

(58) Field of Search ..... 340/539, 426; 701/49, 301, 45

(56) References Cited

U.S. PATENT DOCUMENTS 5,465,079 A * 11/1995 Bouchard et al. ..... 340/539

* cited by examiner

*Primary Examiner*—Daryl Pope
(74) *Attorney, Agent, or Firm*—Morgan & Finnegan LLP

(57) ABSTRACT

Provided is an inexpensive vehicular communication apparatus capable of transferring image data containing a record of an accident to a safe, external location, the apparatus being usable in an ordinary automotive vehicle. The apparatus includes an image sensing device, a data storage device for storing image data that has been captured by the image sensing device, a sensor for sensing impact, a portable-terminal holding device in which a portable terminal is capable of being placed, and an operation controller which, if impact has been sensed by the sensor, is for notifying a prescribed party via the portable terminal unless the portable terminal is removed from the portable-terminal holding device within a predetermined period of time.

18 Claims, 7 Drawing Sheets

VEHICULAR COMMUNICATION APPARATUS, COMMUNICATION METHOD AND COMPUTER-READABLE STORAGE MEDIUM THEREFOR

FIELD OF THE INVENTION

This invention relates a vehicular communication apparatus, communication method and computer-readable storage medium which, in the event of a vehicular accident, can store, at a safe external location, video data in which the circumstances of the accident have been recorded, and which moreover can notify of the occurrence of the accident.

Further, this invention relates a dealing method after the vehicle accident using the communication apparatus and communication method.

BACKGROUND OF THE INVENTION

The specification of Japanese Patent Application Laid-Open No. 6-64565 discloses art in which an automobile is equipped with an apparatus for recording the operating conditions of the automobile and, in the event of an accident, the circumstances such as the external environment at the time. After the accident, the recorded data can be retrieved. This is similar to a black box that is used in aircraft but in this case is applied to an automotive vehicle.

Further, the specification of Japanese Patent Application Laid-Open No. 9-257495 discloses an apparatus for recording the circumstances of an accident. The apparatus discriminates a vehicular accident by exploiting the detection characteristics of a yaw-rate sensor and stores data prevailing at the time of the accident in storage means.

Further, the specification of Japanese Patent Application Laid-Open No. 11-165661 discloses art in which the interior of a traveling automobile is provided with an apparatus that records the constantly changing operating status and present position of the vehicle. If it is sensed that the vehicle has had an accident, the apparatus transmits a signal indicative of this fact to a base station. The specification further describes that the apparatus photographs the surrounding conditions by a CCD camera and sends the base station image data indicative of these conditions via the Internet.

Further, the specification of Japanese Patent Application Laid-Open No. 2000-57467 discloses art in which when a person becomes trapped in an automobile, an external base station is notified of the fact.

The prior-art described above is used in a special-purpose accident recording apparatus and notification apparatus. Apparatus of these kinds are costly, can be employed only in trucks for business purposes and in upscale passenger cars and are difficult to employ in ordinary passenger cars of the popular type.

When a death or serious injury occurs as the result of a vehicular accident, most of the times the vehicle involved is a compact, ordinary car of little strength. As a consequence, a driver or passenger of such an ordinary car not equipped with such an accident recording apparatus and notification apparatus often is at a disadvantage because the individual cannot fully assert his or her own viewpoint of the accident.

In other words, there is need for a system that can be employed in an ordinary automobile and that is capable of recording and reporting the circumstances of an accident satisfactorily.

Further, in the prior art described above, art such as the recording and transmission of accident data is disclosed.

However, no consideration is given to negotiations for compensation following an accident or to processing procedures following an accident. This means that the driver of a vehicle equipped with the above-described apparatus cannot expect to enjoy the advantage of immediate action. As a consequence, such apparatus will not find widespread use in society.

Furthermore, with the prior art disclosed in the specifications of Japanese Patent Application Laid-Open Nos. 6-64565 and 9-257495, there is the danger that recorded data will be lost if the vehicle is destroyed by fire or suffers extensive damage in the event of a major accident such as one involving death. It is necessary, therefore, that recorded data be sent to an external, safe location immediately.

SUMMARY OF THE INVENTION

Accordingly, an object of the present invention is to provide an inexpensive vehicular communication apparatus, communication method and computer-readable storage medium capable of transferring image data containing a record of an accident to a safe, external location, the apparatus being usable in an ordinary automotive vehicle.

According to a first aspect of the present invention, the foregoing object is attained by providing a vehicular communication apparatus mounted on an automotive vehicle, comprising: an image sensing device; a data storage device for storing image data that has been captured by the image sensing device; a sensor for sensing impact; a portable-terminal holding device in which a portable terminal is capable of being placed; and an operation controller which, if impact has been sensed by the sensor, is for notifying a prescribed party via the portable terminal unless the portable terminal is removed from the portable-terminal holding device within a predetermined period of time.

According to a second aspect of the present invention, the foregoing object is attained by providing a vehicular communication apparatus mounted on an automotive vehicle, comprising: an image sensing device; a data storage device for storing image data that has been captured by the image sensing device; a sensor for sensing impact; a portable-terminal holding device in which a portable terminal is capable of being placed; and an operation controller which, if impact has been sensed by the sensor, is for transmitting, to the outside via the portable terminal placed in the portable-terminal holding device, image data that has been stored in the data storage device, and which, if impact has been sensed by the sensor when the portable terminal placed in the portable-terminal holding device is in a communicating state, is for severing this communication and transmitting the image data to the outside.

Further, according to the first aspect of the present invention, the foregoing objects are attained by providing a communication method implemented by installing, in an automotive vehicle, an image sensing device, a data storage device for storing image data that has been captured by the image sensing device, a sensor for sensing impact, and a portable-terminal holding device in which a portable terminal is capable of being placed, wherein if impact has been sensed by the sensor, a prescribed party is notified via the portable terminal unless the portable terminal is removed from the portable-terminal holding device within a predetermined period of time.

According to the second aspect of the present invention, the foregoing object is attained by providing a communication method implemented by installing, in an automotive vehicle, an image sensing device, a data storage device for storing image data that has been captured by the image sensing device, a sensor for sensing impact, and a portable-terminal holding device in which a portable terminal is capable of being placed, wherein if impact has been sensed by the sensor, image data that has been stored in the data storage device is transmitted to the outside via the portable terminal placed in the portable-terminal holding device, and wherein if impact has been sensed by the sensor when the portable terminal placed in the portable-terminal holding device is in a communicating state, this communication is severed and the image data is transmitted to the outside.

The present invention further provides a computer-readable storage medium storing a program that causes a computer to execute the above-described communication method.

In the present invention as described above, the driver of an automotive vehicle places his or her own portable terminal such as a cellular telephone in a portable-terminal holding device provided within the vehicle. The latest image data sent from a camera device such as a CCD camera installed inside the vehicle is stored in a data storage device. If impact is sensed by a sensor, the cellular telephone is placed in a communicating state automatically and the image data that has been stored in the data storage device is transmitted via the cellular telephone to a data processing apparatus operated by an insurance company or the like.

Furthermore, if, after the transmission of the image data, the cellular telephone is not removed from the portable-terminal holding device upon elapse of a predetermined period of time, the police, etc., can be notified of the accident automatically via the cellular telephone. In other words, if an accident is minor and does not necessarily warrant a report to the police, etc., the driver can select whether or not to report the accident. This makes it possible to take steps that more closely conform to real situations.

Other objects and advantages besides those discussed above will be apparent to those skilled in the art from the description of preferred embodiments of the invention which follow. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DESCRIPTION OF THE PREFERRED EMBODIMENTS

Embodiments of a vehicular communication system, vehicular communication apparatus and method and computer-readable storage medium therefor will now be described with reference to the drawings.

(First Embodiment)

Figure 1:
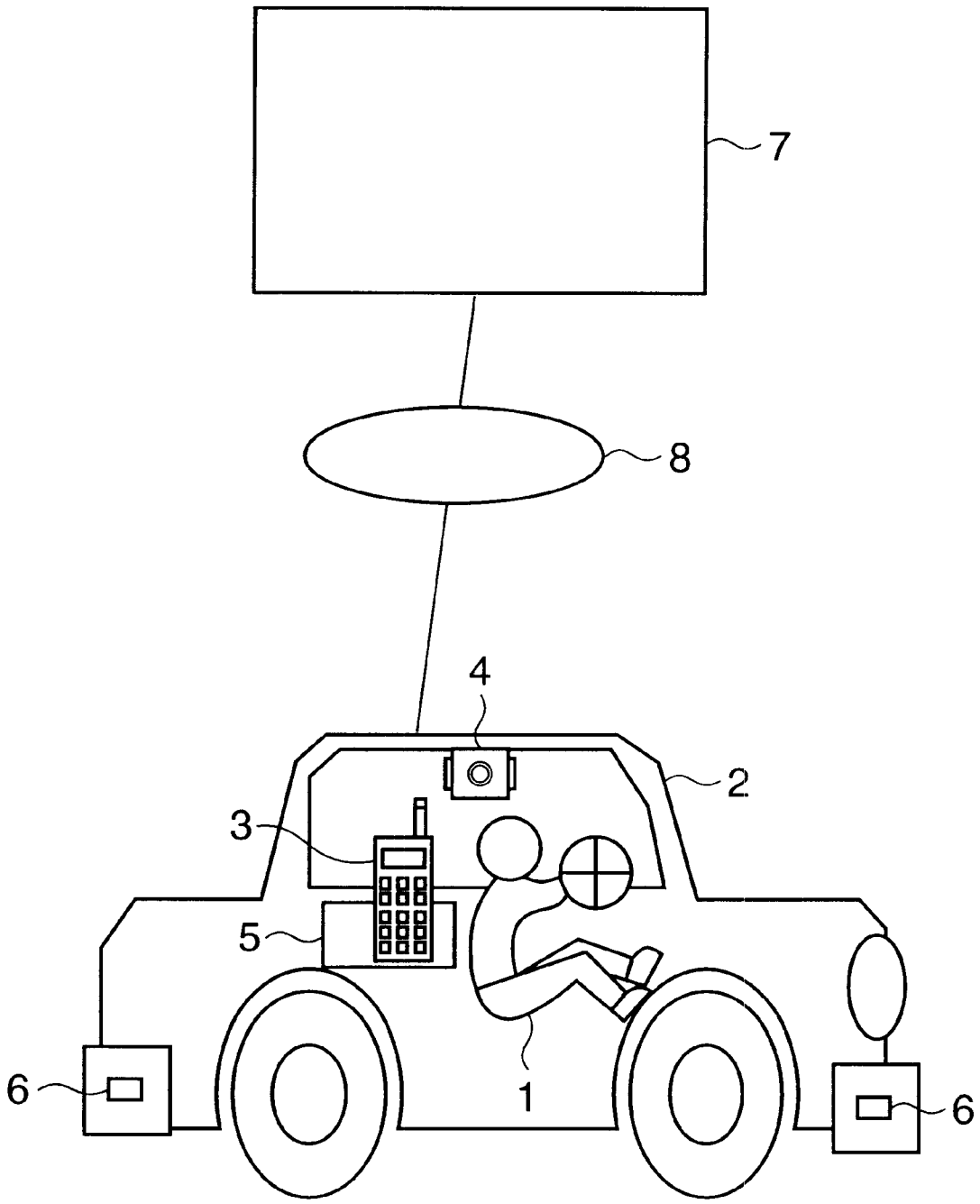
FIG. 1 is a diagram showing the overall configuration of a vehicular communication system.
Figure 2:
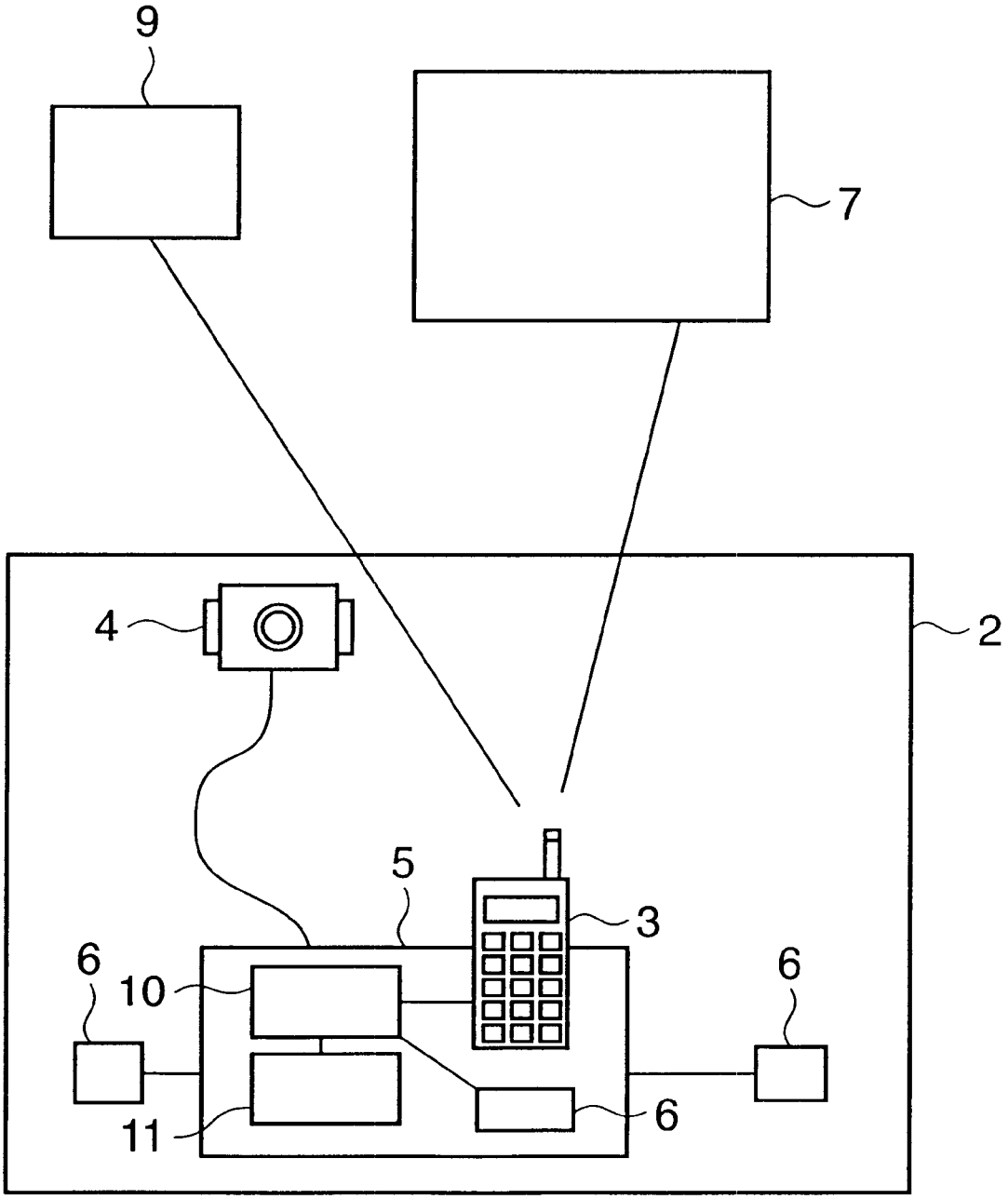
FIG. 2 is a schematic view illustrating in greater detail the overall configuration of the system according to a first embodiment of the present invention.

FIG. 1 is a diagram showing the overall configuration of a vehicular communication system, and FIG. 2 is a schematic view illustrating in greater detail the overall configuration of the system according to a first embodiment of the present invention. When a driver 1 drives an automobile 2, the driver places a cellular telephone 3 in a connection box 5. When the cellular telephone 3 is placed in the connection box 5, an external information connector of the cellular telephone 3 is connected to a prescribed connector in the connection box 5. The connection box 5 is so adapted that the cellular telephone 3 will not fall out once the cellular telephone 3 has been placed in the box.

Connected to the connection box 5 is a CCD camera 4 that is capable of acquiring image data over an angle of 360° to cover the area to the front, rear and on both sides of the vehicle. The CCD camera 4 is mounted on, e.g., the ceiling of the passenger compartment.

Further, impact sensors 6 for sensing impact are connected to the connection box 5. One impact sensor 6 is mounted on the front and the other on the rear of the automobile 2 in, say, the front and rear bumpers.

An operation controller 10, a data storage unit 11, an impact sensor 6 and a power supply (not shown) are provided within the connection box 5.

It is so arranged that a data recording computer of a data recording center 7 run by a third party is connected immediately as the destination of data communication of the cellular telephone 3. In this embodiment, the data recording computer corresponds to a data processing apparatus referred to in the present invention.

Figure 3:
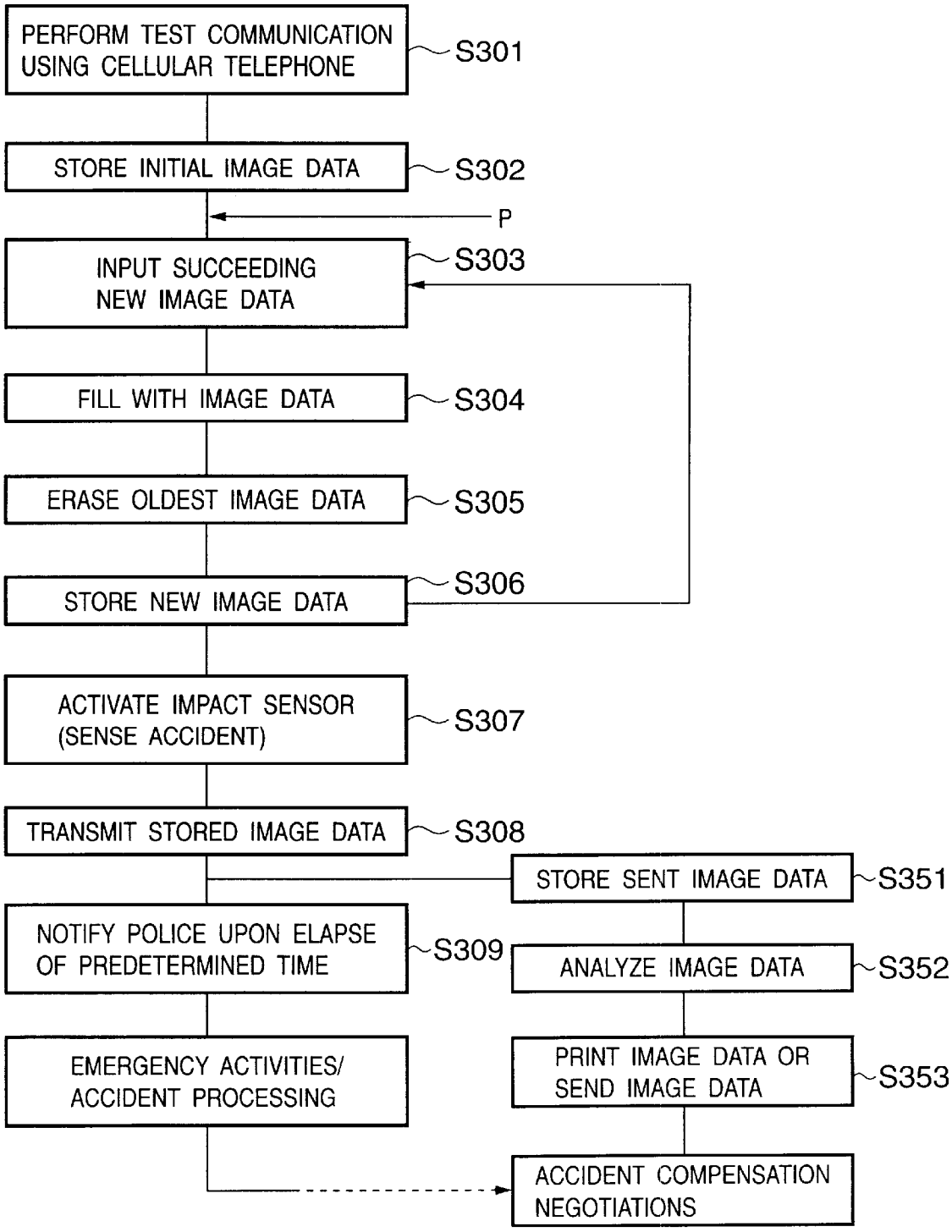
FIG. 3 is a flowchart useful in describing the operation of the first embodiment.

The operation of this embodiment will be described with reference to the flowchart of FIG. 3. When the driver 1 drives the automobile 2, the driver places the cellular telephone 3 in the connection box 5. When this is done, a simple communication test is run in order to check the connection (step S301). The communication test does not entail making an actual connection; it merely requires ringing the data recording center 7. This makes it possible to conduct a test without a connection fee being charged to the driver 1, namely the subscriber to the cellular telephone 3.

With the cellular telephone 3 thus placed in the connection box 5, the driver 1 starts driving the automobile 2. With the cellular telephone 3 placed in the connection box 5, the operation controller 10 instructs the CCD camera 4 to sequentially capture images of the surrounding environment. The image data is sent to and stored in the data storage unit 11 within the connection box 5 (step S302).

The image data is captured at intervals of 0.1 second and sent to the data storage unit 11 (step S303). As a result, image data representing constantly changing conditions outside the vehicle is accumulated in the data storage unit 11.

As the image data is successively transmitted from the CCD camera 4, the driver 1 is filled to capacity with the image data. Upon determining that the data storage unit 11 has been filled with image data (step S304), the oldest image data stored in the data storage unit 11 is deleted (step S305) and new image data of the next instant of time is stored in the data storage unit 11 (step S306). This processing is repeated. Accordingly, the latest image data is always stored in the data storage unit 11. It should be noted that it will suffice if the data storage unit 11 has enough capacity to store five seconds of image data, by way of example.

If the automobile 2 stops being driven without the occurrence of an accident, all of the image data that has been stored in the data storage unit 11 is erased. Alternatively, the data is left in the data storage unit 11 as is. The driver 1 removes the cellular telephone 3 from the connection box 5 and exits the vehicle taking the cellular telephone 3 along.

If an accident occurs during driving of the automobile 2, either of the impact sensors 6 is activated (S307). Upon detecting that the impact sensor 6 has been activated, the operation controller 10 calls the data recording center 7 from the cellular telephone 3 that has been placed in the connection box 5. At the same time that a connection is made to the data recording center 7, all of the image data that has been recorded in the data storage unit 11 is transmitted to the data recording center 7 (step S308). The time needed to transmit the image data is merely 5 to 30 seconds and therefore will not impede a subsequent report to a police station 9.

The connection box 5 is then unlocked. Upon elapse of a predetermined period of time with the cellular telephone 3 being left in the connection box 5 as is, the operation controller 10 causes a report of the accident to be made to the police station 9 from the cellular telephone 3 (step S309). The predetermined period of time can be set in advance by the driver 1. For example, the driver 1 can set the time period freely to 10 seconds, 20 seconds, 30 seconds or one minute, etc.

More specifically, if the accident is a minor accident in which the driver 1 is capable of moving about satisfactorily, the driver can remove the cellular telephone 3 from the connection box 5 within the predetermined period of time. The driver 1 can then decided whether to notify the police. That is, it is possible for the driver to deal with the accident by an out-of-court settlement or by some other means.

In the event of circumstances in which the driver 1 dies or is too seriously injured to move, the driver cannot remove the cellular telephone 3 from the connection box 5. In other words, if the cellular telephone 3 is not removed from the connection box 5 within the predetermined period of time, then it is construed that the driver is severely injured or has died. Accordingly, the operation controller 10 places a telephone call to the police station 9 or to an emergency medical center from the cellular telephone 3 that still remains in the connection box 5. thereby reporting the fact that an accident has occurred.

As an example of the report made to the police station 9 or emergency medical center, it will suffice to repeat a voice message indicating that an accident has just occurred and that an automatic accident reporting unit is functioning because the driver is too severely injured to move. Further, the message would request that the location of the accident be calculated from the communicating location of the cellular telephone 3 and that an ambulance be dispatched immediately.

This report ends when police have arrived at the scene of the accident and the cellular telephone 3 is removed from the connection box 5. Other possible scenarios are that a power supply 13 will be depleted or that the automobile 2 will be destroyed by fire.

It should be noted that the above-mentioned message can include the name and telephone number of the driver 1. For example, the message indicates that an accident has just occurred, gives the name, residential address and telephone number of the driver and indicates that an accident has just occurred and that an automatic accident reporting unit is functioning because the driver is too severely injured to move. Further, the message would request that the location of the accident be calculated from the communicating location of the cellular telephone 3 and that an ambulance be dispatched immediately. If the vehicle is equipped with a GPS (Global Positioning System), a message that includes the present position may be reported.

Thus, even if the driver 1 has died or is too severely injured to move, it is possible for the police station 9 or emergency medical center to be notified automatically. In particular, if the driver 1 is severely injured, it is possible to receive medical attention rapidly. This is vital in saving lives.

The data recording center 7, which has received the image data from the cellular telephone 3 at step S308, stores this image data (step S351), analyzes the image data (step S352) and prints out the image data on a printing medium such as paper or sends the image data per se to the driver 1, i.e., the subscriber (step S353). An arrangement may be adopted in which if the driver 1 dies or is severely injured, the image data is sent to the driver's family.

Thus, even in the event of an accident in which the driver dies or becomes unconscious owing to severe injury, the image data can be used as evidence in investigating the cause of the accident and in post-accident proceedings. The driver 1 or the driver's family, which heretofore might have been in a disadvantageous position, can thus make a presentation of evidence. Further, the image data can be used as a basis for carrying our fair accident proceedings on the side of the damage insurance, life insurance and accident insurance companies with which the driver 1 has a contract.

In accordance with this embodiment as described above, image data can be transmitted and the occurrence of an accident reported by utilizing a cellular telephone currently in wide use and in the possession of most adults. Further, owing to the recent popularization of digital still cameras and digital movie cameras, CCD devices can now be supplied at low price and the CCD camera 4 can be installed without that much additional cost. Further, owing to the rapid spread of computers, semiconductor devices for storage also can be supplied at low cost. It will suffice to apply such devices to the data storage unit 11. Thus, an inexpensive vehicular communication system can be constructed with little special equipment. For example, the above-mentioned CCD camera may be a digital still camera or digital video camera already available on the market. Any arrangement that can be set up to be controlled by a program so that the above-described functions can be implemented from a connection box 5 can be used.

It should be noted that the connection box 5 preferably is constituted by a strong, rigid case for the purpose of protecting the operation controller 10. Further, as for the location at which the connection box is installed, a position that is far from the vehicle exterior but close enough for the driver 1 to operate the cellular telephone 3 is preferred. For example, the connection box 5 preferably is placed at the center of the automobile 2 at a position between the driver and passenger seats.

(Second Embodiment)

Figure 4:
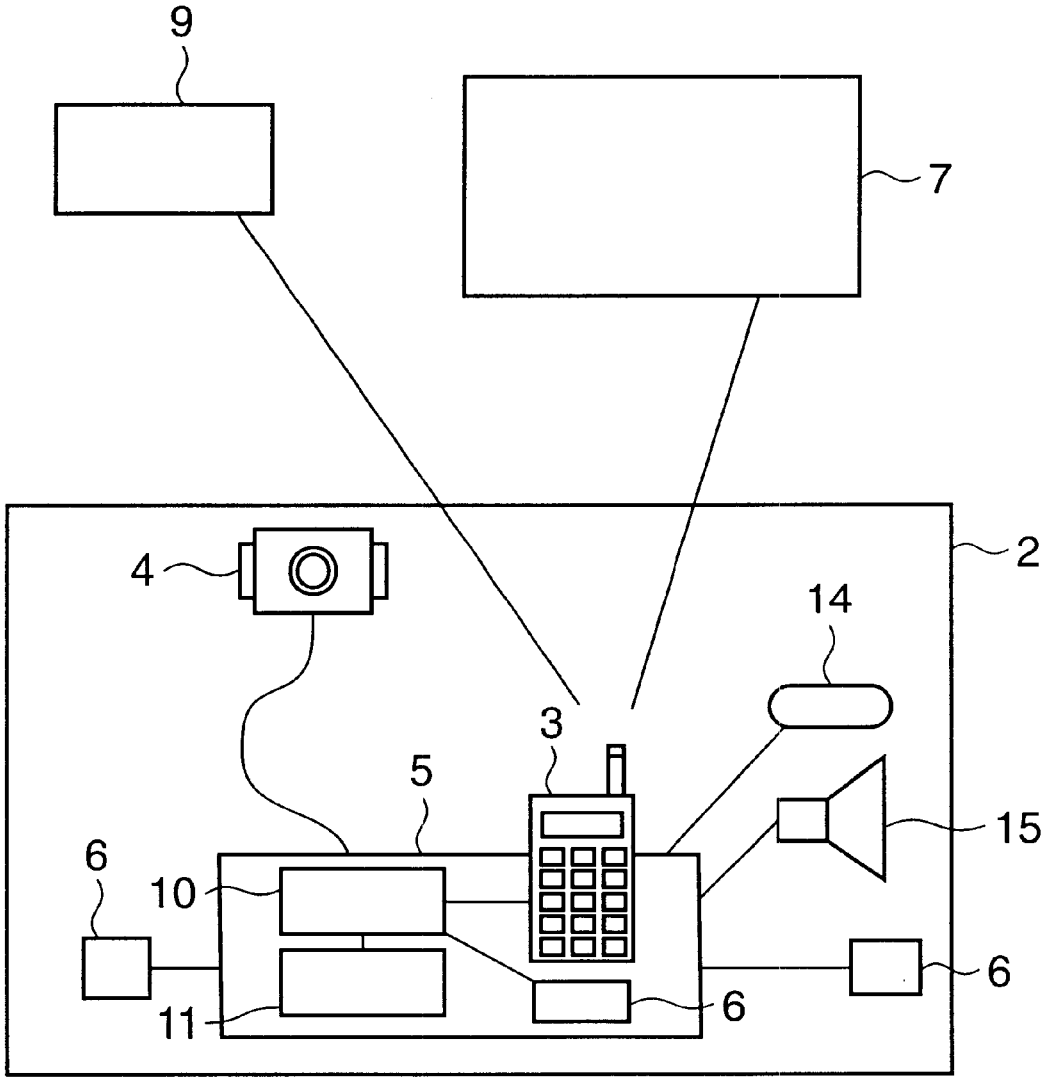
FIG. 4 is a schematic view illustrating in greater detail the overall configuration of the system according to a second embodiment of the present invention.

FIG. 4 is a schematic view illustrating in greater detail the overall configuration of the system according to a second embodiment of the present invention. This embodiment is so adapted that the driver 1 can converse with an outside party during travel using the cellular telephone 3. Components identical with those shown in FIG. 2 are designated by like reference characters and need not be described again.

A microphone 14 and a speaker 15 installed within the vehicle are connected to the connection box 5. If a telephone call is received from someone outside with the cellular telephone 3 placed in the connection box 5, the operation controller 10 activates the cellular telephone 3 so that voice is output to the speaker 15. If the driver 1 responds to this voice, then voice is transmitted from the cellular telephone 3 via the microphone 14 and connection box 5. As a result, it is possible for the driver 1 to continue conversing with the outside caller while driving the automobile 2.

Figure 5:
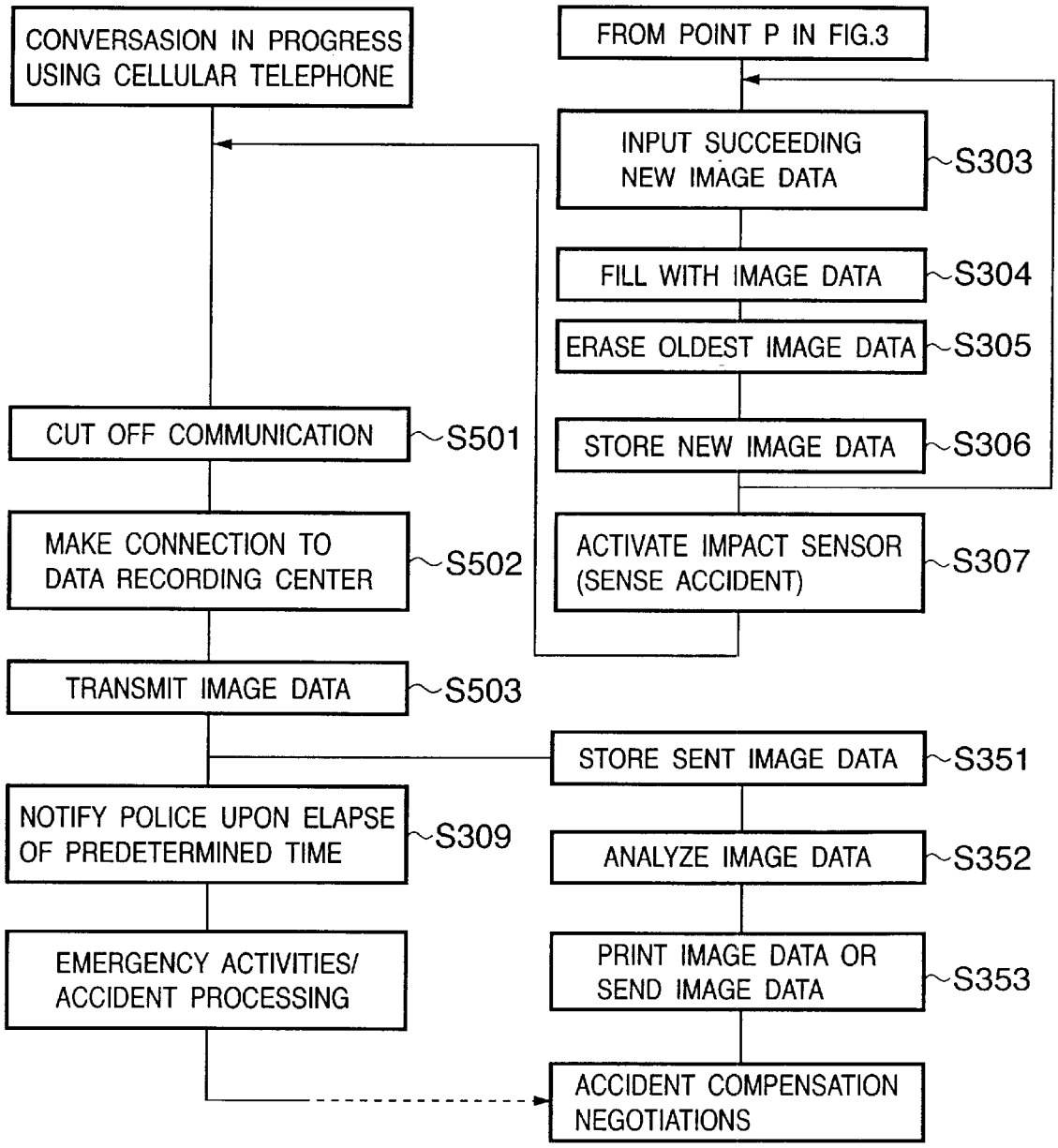
FIG. 5 is a flowchart useful in describing the operation of the second embodiment.

The operation of this embodiment will now be described with reference to the flowcharts of FIGS. 5 and 6. Processing steps in these flowcharts identical with those shown in FIG. 3 are designated by like step numbers and need not be described again.

Assume that an accident has occurred while the driver 1 is carrying on a television conversation using the microphone 14 and speaker 15. In this case, either of the impact sensors 6 is activated (S307) and the operation controller 10 cuts off the connection between the cellular telephone 3 and the outside party (step S501)

Next, a call is placed to the data recording center 7 from the cellular telephone 3 that has been placed in the connection box 5 and all image data that has been recorded in the data storage unit 11 is transmitted (steps S502, S503) in the manner described in the first embodiment. The connection box 5 is then unlocked and the cellular telephone 3 notifies the police station 9 of the accident upon elapse of a predetermined period of time.

In this case a voice message is transmitted indicating that an accident has just occurred and that an automatic accident reporting unit is functioning because the driver is too severely injured to move. Further, the message requests that the location of the accident be calculated from the communicating location of the cellular telephone 3 and that an ambulance be dispatched immediately. In addition, the message is output as voice from the speaker 15. Transmission of this message and output of voice are performed at suitable intervals, i.e., at intervals of about three seconds.

In a case where the voice of the driver 1 or the voice of a passenger is sensed via the microphone 14 within these three seconds, the voice of the driver can be transmitted so that the driver may converse with the police station 9. In such case it is possible for the driver 1 to report the location and circumstances of the accident to the police station 9. Even if the cellular telephone 3 is removed from the connection box 5, the driver can continue conversing with the police station 9. This means that the driver 1 can continue reporting the circumstances of the accident even when the driver is outside the vehicle.

Further, in a case where the cellular telephone 3 is not removed from the connection box 5, voice contact is achieved within the above-mentioned three seconds and then voice response ceases, the above-mentioned message continues to be repeated. The reason for this is that even if the driver 1 loses consciousness in the middle of a conversion, continuous communication by the cellular telephone 3 will make it possible to roughly identify the position of the vehicle from the communication response time or on the basis of the communicating base station, or from a difference in response times when there is an instantaneous changeover from one base station to another.

In regard to cut-off of the conversation with the outside party at step S501 owing to impact sensed by the impact sensor 6, a message that takes the conversing party into account is transmitted. The message indicates that a vehicular accident has just occurred and that the call to the party will be disconnected in order to report the accident broadly. The call is cut off after transmission of this message. Thus, it is possible to disconnect a call while taking the conversing party into account.

Figure 6:
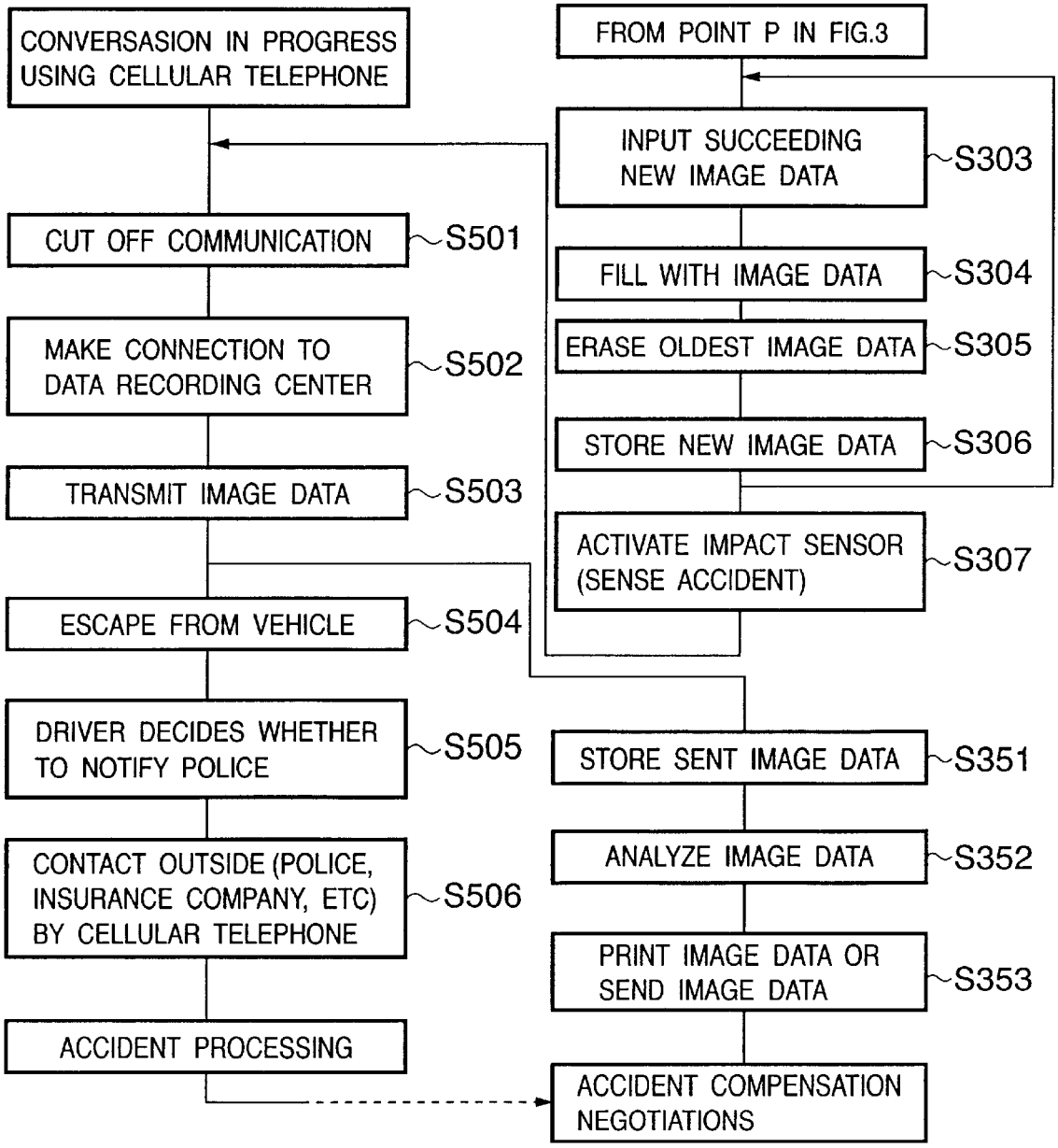
FIG. 6 is a flowchart useful in describing the operation of the second embodiment.

FIG. 6 is a flowchart illustrating an example of operation in a case where the accident is minor enough to allow the driver 1 to move about and the driver removes the cellular telephone 3 from the connection box in a predetermined period of time. This flowchart was not described in connection with the first embodiment. Specifically, in a case where the driver removes the cellular telephone 3 from the connection box 5 before elapse of the predetermined time and escapes from the vehicle following an accident (step S504), the driver 1 decides whether to report the accident to the police (step S505) and then contacts the police or an insurance company, etc., from the cellular telephone 3 as required (step S506).

(Third Embodiment)

Figure 7:
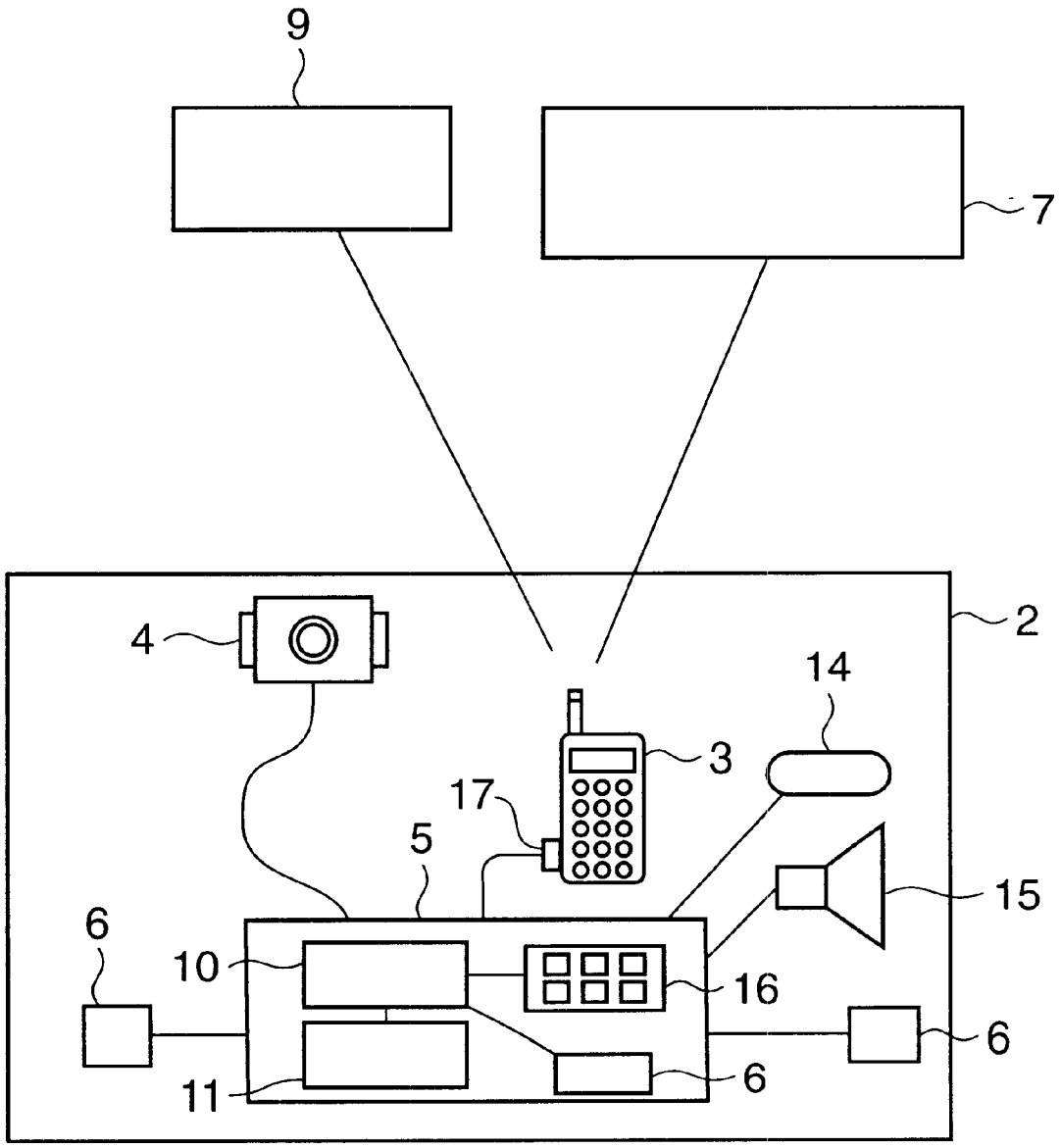
FIG. 7 is a schematic view illustrating in greater detail the overall configuration of the system according to a third embodiment of the present invention.

FIG. 7 is a schematic view illustrating in greater detail the overall configuration of the system according to a third embodiment of the present invention. This embodiment is so adapted that if the driver 1 has forgotten his or her own cellular telephone, the cellular telephone 3 of a passenger can be placed in the connection box 5. Components identical with those shown in FIGS. 2 and 4 are designated by like reference characters and need not be described again.

If the driver 1 has forgotten his or her own cellular telephone and a passenger has placed his or her own cellular telephone 3 in the connection box 5, the connection usually is refused. However, by operating a special key 16 provided on the connection box 5, the driver 1 enables the connection box 5 to communicate with the data recording center 7 from the passenger's cellular telephone 3. Once the passenger's cellular telephone 3 has been placed in the connection box 5, therefore, a test communication is made to check that a call can be made and to confirm that data can be communicated.

Since cellular telephones are made by a variety of companies and are of different shapes and sizes, there are many situations in which it will not be possible to place the cellular telephone at the prescribed place in the connection box 5. In such case the cellular telephone 3 is connected to the connector using a connection cord 17 with which the connection box 5 is separately provided. As a result, though the connection box 5 cannot be locked, image data can be transmitted to the data recording center 7 in the event of an accident and the police station 9 can be notified subsequently.

In addition to the first to third embodiments described above, it is possible to adopt an arrangement in which when the driver 1 leaves the vehicle 2 while carrying the cellular telephone 3, the driver first places the CCD camera 4 and the operation controller 10 in the operating state. If another vehicle subsequently hits or collides with the automobile 2 and then leaves the scene, the operation controller 10 will record the image data in the data storage unit 11. Then, when the driver 1 returns and places the cellular telephone 3 in the connection box 5, the image data that shows the accident will be transmitted to the data recording center 7 immediately. This will make it possible to identify the other vehicle on the basis of the image data.

Further, if the impact sensed by the impact sensor 6 is small, this indicates that the accident is not a major accident. Though the image data is sent, therefore, instances in which the driver 1 is injured are few. In such cases the parties to the accident enter into discussions (negotiations regarding a settlement out of court) concerning the causes of the accident and compensation, etc. In this case, if the automobile 2 is equipped with a printer or an image output unit (CRT, etc.) and image data can be output immediately from the data storage unit 11, then it will be possible to carry out negotiations fairly.

Furthermore, it is possible for a data recording computer at the data recording center 7 that has received accident image data to contact immediately an individual that is in charge of the handling of accidents, and this individual can give negotiation advice to the driver 1 via the cellular telephone 3. Alternatively, if the accident is minor, the image data can be received by the above-mentioned individual and then this individual can contact the driver 1 via the cellular telephone 3. This makes it possible to take more effective measures.

While observing the received image data, the individual in charge of the handling of accidents can surmise the cause of the accident immediately based upon past experience. If it is determined by this individual that the driver 2 has little responsibility for the accident, the driver 2 can assert this fact emphatically in an effort to reduce any costs resulting from the accident. As a result, the accident can be dealt with fairly and the insurance company also need not bear any unnecessary burden.

(Fourth Embodiment)

If use is made to a cellular telephone equipped with a digital imaging camera function, the aforementioned CCD camera will be unnecessary. The connection box 5 can be placed near the center of the ceiling of the passenger compartment or on the vehicle dashboard and the cellular telephone having the camera function can mounted on the connection box 5. When the cellular telephone 3 is connected to a connection terminal in this case, image data from the digital imaging camera of the cellular telephone 3 is input to the connection box 5 so that processing similar to that described in the first embodiment can be executed. Further, if it is desired to acquire images in four directions (over an angular range of 360°), four cellular telephones can be used or separate digital imaging cameras having the above-described function can be additionally connected to the cellular telephone 3. In each of these cases it will of course be necessary for the connection box 5 to have a program that controls the cellular telephone 3 having the digital imaging camera function.

(Other Embodiments)

The present invention covers an arrangement in which program codes of the software for implementing the functions of the foregoing embodiments are supplied to a computer in an apparatus or system connected to various devices so that these devices may implement the functions of the above embodiments, and these devices are operated in accordance with a program that has been stored in the computer (e.g., a CPU or MPU) of the system or apparatus.

In this case, the program codes read from the storage medium themselves implement the functions of the above embodiments. The program codes per se and means for supplying the program codes to the computer, e.g., a recording medium storing the program codes, constitute the present invention. Examples of storage media that store the program code are a floppy disk, hard disk, optical disk, magneto-optical disk, CD-ROM, CD-R, magnetic tape, non-volatile type memory card or ROM, etc.

Furthermore, besides the case where the aforesaid functions according to the embodiments are implemented by executing the supplied program codes by a computer, it goes without saying that the present invention covers the program code also in a case where an operating system or other application software running on the computer implements the functions of the above embodiments.

It goes without saying that the present invention further covers a case where, after the supplied program codes are stored in a memory provided on a function expansion board of the computer or in a function expansion unit connected to the computer, a CPU or the like provided on the function expansion board or in the function expansion unit performs all or a part of the actual processing and the functions of the above embodiments are implemented by this processing.

It should be noted that the configuration and structure of the components illustrated in the above-described embodiments merely illustrate one example for putting the present invention in concrete form. The technical scope of the present invention should not be interpreted as being unduly narrowed by these embodiments. In other words, the present invention can be worked in various forms without departing from the spirit of the invention and the main features thereof.

In accordance with the embodiments of the invention as described above, use is made of a portable terminal such as a cellular telephone in the possession of a driver to report the occurrence of a vehicular accident. This is economical as it is unnecessary to establish a separate wireless link to report the accident. The invention therefore is extremely practical as it can be deployed widely in ordinary automobiles.

Moreover, image data representing circumstances that prevailed prior to the occurrence of an accident are transmitted to the outside and stored. Even if the vehicle is destroyed by fire, therefore, the data will remain so that the accident can be processed fairly. As a result, the insurance company involved is capable of dealing with the accident fairly and promptly.

Further, if it is so arranged that a portable terminal reports an accident automatically, the report can be made rapidly even if the driver is severely injured. If the reporting of the accident continues, the location of the accident can be calculated roughly from the communication response time or by specifying the base station. This is more effective in protecting the life of the driver.

The present invention is not limited to the above embodiments and various changes and modifications can be made within the spirit and scope of the present invention. Therefore, to apprise the public of the scope of the present invention, the following claims are made.

What is claimed is:

1. A vehicular communication apparatus mounted on an automotive vehicle, comprising:

an image sensing device;

a data storage device for storing image data that has been captured by said image sensing device;

a sensor for sensing impact;

a portable-terminal holding device in which a portable terminal is capable of being placed; and an operation controller which, if impact has been sensed by said sensor, is for notifying a prescribed party via said portable terminal unless said portable terminal is removed from said portable-terminal holding device within a predetermined period of time.

2. The apparatus according to claim 1, wherein if impact has been sensed by said sensor, said operation controller transmits the image data, which has been stored in said data storage device, to the outside via the portable terminal placed in said portable-terminal holding device.

3. The apparatus according to claim 1, wherein said operation controller erases old image data that has been stored in said data storage device and stores new image data in said data storage device.

4. The apparatus according to claim 1, wherein the prescribed party is the police.

5. The apparatus according to claim 1, wherein said portable terminal is a cellular telephone.

6. A vehicular communication apparatus mounted on an automotive vehicle, comprising:

an image sensing device;

a data storage device for storing image data that has been captured by said image sensing device;

a sensor for sensing impact;

a portable-terminal holding device in which a portable terminal is capable of being placed; and an operation controller which, if impact has been sensed by said sensor, is for transmitting, to the outside via the portable terminal placed in said portable-terminal holding device, image data that has been stored in said data storage device, and which, if impact has been sensed by said sensor when the portable terminal placed in said portable-terminal holding device is in a communicating state, is for severing this communication and transmitting the image data to the outside.

7. The apparatus according to claim 6, wherein said operation controller erases old image data that has been stored in said data storage device and stores new image data in said data storage device.

8. The apparatus according to claim 6, wherein said portable terminal is a cellular telephone.

9. A communication method implemented by installing, in an automotive vehicle, an image sensing device, a data storage device for storing image data that has been captured by said image sensing device, a sensor for sensing impact, and a portable-terminal holding device in which a portable terminal is capable of being placed, wherein if impact has been sensed by said sensor, a prescribed party is notified via said portable terminal unless said portable terminal is removed from said portable-terminal holding device within a predetermined period of time.

10. The method according to claim 9, wherein if impact has been sensed by said sensor, the image data, which has been stored in said data storage device, is transmitted to the outside via the portable terminal placed in said portable-terminal holding device.

11. The method according to claim 9, wherein old image data that has been stored in said data storage device is erased and new image data is stored in said data storage device.

12. The method according to claim 9, wherein the prescribed party is the police.

13. The method according to claim 9, wherein said portable terminal is a cellular telephone.

14. A communication method implemented by installing, in an automotive vehicle, an image sensing device, a data storage device for storing image data that has been captured by said image sensing device, a sensor for sensing impact, and a portable-terminal holding device in which a portable terminal is capable of being placed, wherein if impact has been sensed by said sensor, image data that has been stored in said data storage device is transmitted to the outside via said portable terminal placed in said portable-terminal holding device, and wherein if impact has been sensed by said sensor when said portable terminal placed in said portable-terminal holding device is in a communicating state, this communication is severed and the image data is transmitted to the outside.

15. The method according to claim 14, wherein old image data that has been stored in said data storage device is erased and new image data is stored in said data storage device.

16. The method according to claim 14, wherein said portable terminal is a cellular telephone.

17. A computer-readable storage medium storing a program that causes a computer to execute the communication method set forth in claim 9.

18. A computer-readable storage medium storing a program that causes a computer to execute the communication method set forth in claim 14.

* * * * *

UNITED STATES PATENT AND TRADEMARK OFFICE

CERTIFICATE OF CORRECTION

PATENT NO. : 6,472,982 B2
DATED : October 29, 2002
INVENTOR(S) : Masataka Eida et al.

It is certified that error appears in the above-identified patent and that said Letters Patent is hereby corrected as shown below:

Column 8,
Line 2, "box in" should read -- box 5 in --

Signed and Sealed this

Sixth Day of January, 2004

JAMES E. ROGAN
*Director of the United States Patent and Trademark Office*